United States Patent [19]

Katayama

[11] Patent Number: 5,056,788

[45] Date of Patent: Oct. 15, 1991

[54] CLUB SET WITH PROGRESSIVELY ALTERED HOSEL THICKNESS AND HEAD WEIGHT

[75] Inventor: Yutaka Katayama, Tokyo, Japan

[73] Assignee: Maruman Golf Kabushiki Kaisha, Tokyo, Japan

[21] Appl. No.: 401,688

[22] Filed: Sep. 1, 1989

[30] Foreign Application Priority Data

Sep. 2, 1988 [JP] Japan ..... 63-218439

[51] Int. Cl.[5] ..... A63B 53/04

[52] U.S. Cl. ..... 273/77 A; 273/80.2; 273/80.5; 273/167 F

[58] Field of Search ..... 273/167 R, 167 A, 167 D, 273/167 F, 167 J, 167 K, 169, 171, 172, 174, 80.2, 80.5

[56] References Cited

U.S. PATENT DOCUMENTS

| | | | |
|---|---|---|---|
| 835,735 | 11/1906 | Robertson | 273/167 F |
| 2,231,847 | 2/1941 | Dickson et al. | 273/167 K |
| 3,655,188 | 4/1972 | Solheim | 273/77 A |
| 4,322,083 | 3/1982 | Imai | 273/167 F |
| 4,512,577 | 4/1985 | Solheim | 273/167 A |
| 4,632,400 | 12/1986 | Boone | 273/167 K |
| 4,858,929 | 8/1989 | Long | 273/77 A |
| 4,923,197 | 5/1990 | Sahacht | 273/77 A |

FOREIGN PATENT DOCUMENTS 59-12915 4/1983 Japan .

OTHER PUBLICATIONS

"Stag U.S.A.", Golf Digest, Dec. 1974, p. 2.

*Primary Examiner*—Edward M. Coven
*Assistant Examiner*—William M. Pierce
*Attorney, Agent, or Firm*—Armstrong, Nikaido, Marmelstein, Kubovcik & Murray

[57] ABSTRACT

An iron golf club including a head with a hitting portion having a hitting surface for hitting a golf ball, a hosel and a connecting wall extending between the hitting portion and the hosel and forming a hosel pocket. In an iron golf club set, the thickness of the hosel pocket wall is made smaller to thin the surface of the wall on the side of the hitting surface as the length of the shaft becomes shorter.

1 Claim, 2 Drawing Sheets

CLUB SET WITH PROGRESSIVELY ALTERED HOSEL THICKNESS AND HEAD WEIGHT

BACKGROUND OF THE INVENTION

1. Field of the Invention

The present invention relates to an iron golf club set.

2. Description of the Related Art

An iron golf club comprises a shaft and a head with a hitting portion having a hitting surface for hitting a golf ball, as is well known, and a sole provided at the bottom of the head. A plurality of iron golf clubs compose an iron golf club set, and have relative and well balanced configurations and dimensions. Usually, the clubs in the set are called long iron golf clubs, middle iron golf clubs, and short iron clubs and wedges, in accordance with the number of the iron golf club.

Japanese Examined Utility Model Publication No. 59-12915 discloses an iron golf club set in which a weighted portion is provided at the rear surface of the head of each of the iron golf clubs. The position of the weighted portion is varied in each iron golf club and is displaced nearer to the sole as the length of the iron golf club in the set becomes shorter, based on the fact that the loft becomes larger and the hitting point becomes lower as the length of the iron golf club in the set becomes shorter.

Usually, identical features are given to every iron golf club in the conventional iron golf club set, except for the length of the shafts and the loft. But in the above recited Japanese Examined Utility Model Publication No. 59-12915, the weighted portion in the rear surface of the head in each iron golf club is displaced to thereby vary the position of the sweet spot, and the area of the sweet spot is widened. Accordingly, there have been recent proposals to vary the same features in the same iron golf club set. Further, there is a "shank" or "socket" hit occurs when a short iron golf is used, i.e., the golf ball is hit by the head at a portion adjacent to the hosel and adjacent to the hitting surface, and in this case, the golf ball is sliced far to the right of the target flight line. Among the iron golf clubs in the same set, a shank hit will be often caused by the short iron golf clubs, because the player is apt to swing the short iron golf club hastily or in a strained condition, and as a result, the player swings while slouching or on tip-toe with the heels off the ground, so that the head of the iron golf club passes the address point and the golf ball is hit by the portion adjacent to the hosel and adjacent to the hitting surface. The shank hit will also be caused by a hasty approach shot in which the arms are away from the side of the player.

SUMMARY OF THE INVENTION

The object of the present invention is to provide an iron golf club set in which the occurrence of a shank hit when using the short iron golf clubs is reduced.

An iron golf club set, according to the present invention, comprises a plurality of iron golf clubs, each of said iron golf clubs including a shaft and head with a hitting portion having a hitting surface for hitting a golf ball, a hosel connecting the head to the shaft, and a connecting wall extending between the hitting portion and the hosel and forming a hosel pocket, wherein the thickness of the hosel pocket is made smaller to thin the surface of the connecting wall on the side of the hitting surface as the length of the shaft in the set becomes shorter.

In this arrangement, the thickness of the hosel pocket wall becomes thinner, and thus the hosel pocket becomes deeper relative to the hitting surface as the length of the shaft in the set becomes shorter. Therefore, a portion of the head adjacent to the hosel is retracted, and thus a shank hit will be less likely to occur even if the golf ball is hit by the head at a portion near the hosel.

BRIEF DESCRIPTION OF THE DRAWINGS

The present invention will become more apparent from the following description of the preferred embodiment with reference to the accompanying drawings, in which.

DESCRIPTION OF THE PREFERRED EMBODIMENT

Figure 1:
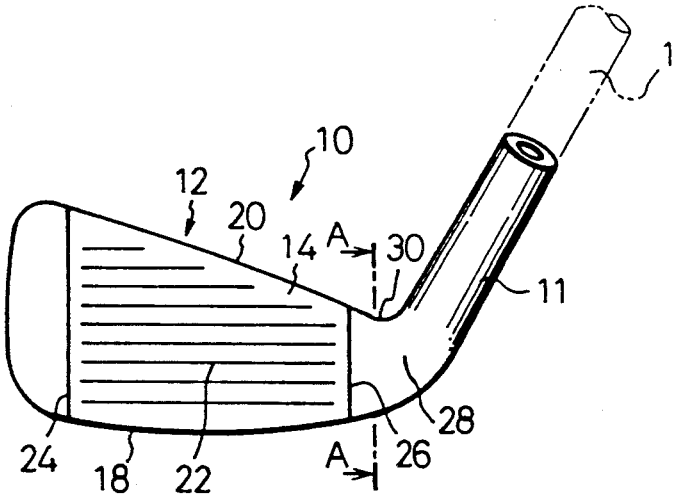
FIG. 1 is a front side view of a head of an iron golf club.
Figure 2:
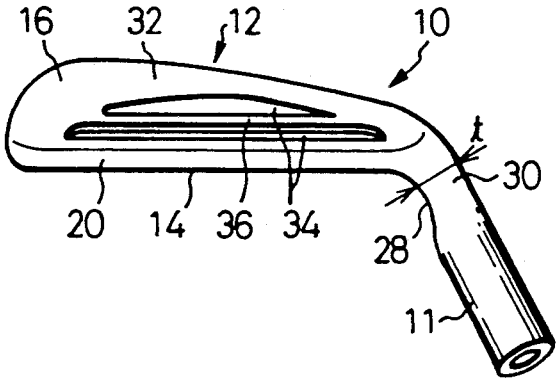
FIG. 2 is a back side view of the iron golf club shown in FIG. 1.
Figure 3:
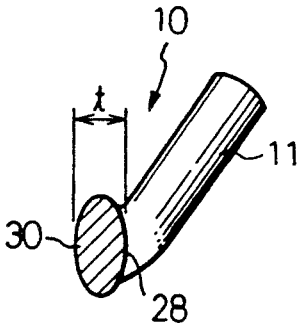
FIG. 3 is a sectional view of the iron golf club in FIG. 1, taken along the line A—A in FIG. 1; shown

Referring to FIG. 1 to 3, an iron golf club comprises a shaft 1 and a head 10. The head 10 comprises a hosel 11 connecting the head 10 to the shaft 1 in a known manner and a hitting portion 12 having a hitting surface 14 for hitting a golf ball, a rear surface 16, and a sole 18. A blade 20 extends at the top edge of the hitting surface 14 and a scored area 22 is provided on the hitting surface 14. The scored area 22 is defined by a toe side scoring boundary line 24 and a heel side scoring boundary line 26.

As shown in FIGS. 1 to 3, a hosel pocket 28 is formed in the head 10 adjacent to the hosel 11. The hosel pocket 28 is formed on the surface of a connecting wall 30 interconnecting the hitting portion 12 and the hosel 11, which constitute a loft (angel) therebetween. That is, the connecting wall 30 extends from the blade 20 to the hosel 11. According to the present invention, the thickness of the connecting wall 30 is made smaller to thin the surface of the hosel pocket 28 on the side of the hitting surface 14 as the length of the shaft in the set becomes shorter. Namely, the surface of the connecting wall 30 on the side of the hitting surface 14 becomes deeper or is retracted, to prevent a shank hit. The following table shows an example of the thickness (millimeters) of the connecting wall 30 forming the hosel pocket 28 of the iron golf clubs in the iron golf club set according to the present invention. The length of the iron golf clubs in the iron golf club set varys in order, in correspondence with the number of the iron golf clubs. A measurement of the thickness of the connecting wall in the conventional iron golf clubs has shown that the thickness is in the range of 9.5 to 10.5 millimeters in many samples and that the thickness is substantially uniform in the iron golf club set.

| 3i | 4i | 5i | 6i | 7i | 8i | 9i | PW | AW |
|---|---|---|---|---|---|---|---|---|
| 10.5 | 10.5 | 10.5 | 10.0 | 9.5 | 9.5 | 9.0 | 8.5 | 8.0 |

As shown in FIG. 2, there is a design formed in the rear surface 16. In the embodiment, an enclosing rim wall 32 forms a recess 34 over substantially the entire region of the rear surface 16, and a horizontally extending rib-like weighted portion 36 is provided in the recess 34. The weighted portion 36 can be formed so that it divides the recess 34 into two sections, as shown in FIG. 2, or it can be formed to be an island in the recess 34. The position of this weighted portion 36 is located at the back of the hitting point and displaced nearer to the sole 18 as the length of the iron golf club in the set becomes shorter.

Figure 4:
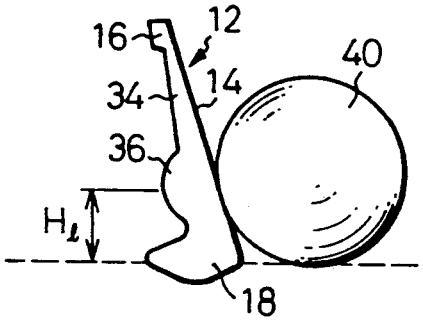
FIG. 4 is a view illustrating a long iron golf club when hitting a golf ball; and, FIG. 5 is a view illustrating short iron golf club when hitting a golf ball.
Figure 5:
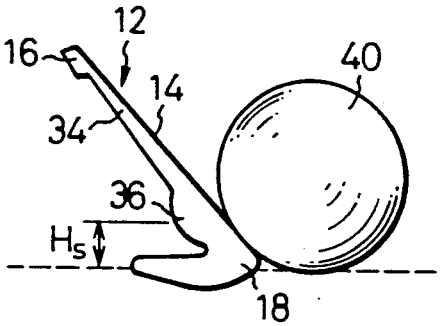

As shown in FIG. 4 the loft is small in the case of a long iron golf club, so that the hitting point (the height $H_l$) of the golf ball 40 becomes high. The position of the weighted portion 36 is correspondingly high, and thus it is possible for the center of gravity and the sweet spot to conform to or be located near the hitting point. As shown in FIG. 5, the loft is large in the case of the short iron golf club, and the hitting point (the height $H_S$) of the golf ball 40 is lowered. The position of the weighted portion 36 is corresponding low, and thus it is possible for the center of gravity and the sweet spot to conform to or be located near the hitting point. The enclosing rim wall 32 over substantially the entire region of the rear surface 16 ensures a widening of the area of the sweet spot.

As explained above, in the iron golf club set according to the present invention, the thickness of the connecting wall is made smaller, and thus the hosel pocket becomes deeper, as the length of the shaft in these becomes shorter, so that portion of the head adjacent to the hosel is retracted, and accordingly, a shank hit is less likely to occur even if the golf ball is hit by the head near the hosel. In addition, where a weighted portion is provided on the rear surface of the head of each of the iron golf clubs, the weighted portion is displaces nearer to the sole as the length of the iron golf club in the set becomes shorter, whereby the position of the center of the gravity of the head becomes higher as the length of the iron golf club in the set becomes longer, so that it is possible for the center of gravity to conform to the hitting point within a wide sweet spot area, to thereby improve the hitting efficiency of the player by ensuring a stable swing.

I claim:

1. In a set of golf club irons consisting of long irons and short irons, each of said clubs having a shaft and a head, said head having a hitting portion with a hitting surface for hitting a golf ball, a hosel connecting said head to said shaft, a connecting wall on said head extending between said hitting portion and said hosel, said connecting wall forming a hosel pocket and having a thickness progressively smaller in said golf club in said set from a longest of said long irons to a shortest of said short irons, said connecting wall on the side of said hitting surface and between said hitting portion of said club head and said hosel being retracted for preventing a shank hit of a golf ball hit with said each of said club irons, said head of each of said clubs having a rear surface, a sole between said rear surface and said hitting surface and a weighted portion on said rear surface of said head, said weighted portion being progressively closer on said rear surface to said sole in said golf clubs in said set from said longest of said long irons to said shortest of said short irons.

* * * * *